United States Patent [19]

Hopwood et al.

[11] Patent Number: 4,749,995

[45] Date of Patent: Jun. 7, 1988

[54] PHASED ARRAY RADAR ANTENNA SYSTEM

[75] Inventors: Francis W. Hopwood, Severna Park; Jerry A. Kane, Crofton, both of Md.

[73] Assignee: Westinghouse Electric Corp., Pittsburgh, Pa.

[21] Appl. No.: 705,575

[22] Filed: Feb. 26, 1985

[51] Int. Cl.[4] ..... H01Q 3/22

[52] U.S. Cl. ..... 342/371

[58] Field of Search ..... 343/371, 372, 378–380, 343/383, 16 R, 17.5; 342/371, 372, 378–380, 383, 74, 81, 98, 147–149, 152–158, 194, 195, 200, 196

[56] References Cited

U.S. PATENT DOCUMENTS

| | | | |
|---|---|---|---|
| 3,517,389 | 6/1970 | Dausin | 343/371 |
| 4,123,719 | 10/1978 | Hopwood et al. | 342/174 X |
| 4,160,958 | 6/1979 | Mims et al. | 331/178 |
| 4,160,975 | 7/1979 | Steudel | 342/196 X |
| 4,217,587 | 8/1980 | Jacomini | 343/372 |
| 4,263,600 | 4/1981 | Williams et al. | 343/372 |

OTHER PUBLICATIONS

"The Series 320 Radar Family", by R. Rosien; Eascon '80 Conference Record, pp. 182–189.

*Primary Examiner*—Theodore M. Blum
*Assistant Examiner*—Bernarr E. Gregory
*Attorney, Agent, or Firm*—W. G. Sutcliff

[57] ABSTRACT

An electronically steerable phased array radar antenna system for transmitting and receiving broadband linear FM signals is detailed. The antenna comprises a plurality of subarrays, each of which are connected by circulator means to a transmit-receive module. The highly linearized FM waveform is fed to the transmit-receive module, and a CW waveform is fed to a phase shifter in the module. The phase shifter applies a frequency offset to the CW waveform which is then added to the linear FM wideband signal for each antenna subarray. This frequency offset serves a beam steering function and can be considered a synthetic time delay.

5 Claims, 3 Drawing Sheets

PHASED ARRAY RADAR ANTENNA SYSTEM

BACKGROUND OF THE INVENTION

The present invention relates to phased array radar systems, and more particularly to such electronically steerable systems designed for operation with broadband linear FM signals.

A phased array radar system employs a fixed, generally planar antenna array made up of individual or subarrays of radiating elements. The radiation pattern generated has a shape and direction which is determined by the relative phases and amplitudes of the currents at the individual radiating elements. The relative phases of the outputs from the individual radiating elements are varied to electronically steer the beam. A general description of electronically steered phased-array radar systems can be had from, "Introduction to Radar Systems", by M. I. Skolnik, 2nd ed. 1982, McGraw-Hill.

A phased array antenna beam steering controller is taught in U.S. Pat. No. 4,217,587, owned by the assignee of the present invention. A highly linearized FM waveform generation system is taught by U.S. Pat. No. 4,160,958, also owned by the assignee of the present invention. Such a linear FM waveform generator can provide wideband waveforms for phased array radars.

It is well understood that phased array radar antenna systems must use some form of time delay mechanism to hold a radiated beam in a constant spatial position when using a broadband signal. This is illustrated in FIG. 1 of the drawings. Mechanizing broadband time delay elements for a phased array radar antenna is a difficult problem. The total time delay required is determined by the array size, and for a 10 foot array steering ±60 degrees, the outer array elements need selectable time delay of up to 10 nanoseconds, while the inner elements need up to 5 nanoseconds. Such time delay elements built using conventional microwave techniques tend to be physically large and awkward, and lossy, and have a very limited power handling capability. It is generally not feasible to drive significant amounts of transmitter power through such time delay elements.

A wideband phased array radar antenna system is taught by U.S. Pat. No. 4,263,600. This prior art system seeks to phase shift the full wideband signal which is applied directly to the phase shifters. This system would be very difficult to implement due to phase shifter hardware limitations for handling the wideband signal.

The present invention is directed to providing a solution to the time delay steering problem for use with wideband linear FM waveform, phased array antenna systems. This solution employs conventional hardware to generate a synthetic time delay.

SUMMARY OF THE INVENTION

An electronically steerable, phased array radar antenna system for transmitting and receiving broadband linear FM signals is detailed. The antenna comprises a plurality of antenna subarrays, with each subarray connected by circulator means to a transmit-receive module. The transmit-receive module during transmit mode is fed a highly linearized FM waveform to which is added a frequency offset CW waveform to provide a predetermined frequency offset linear FM wideband signal for each antenna subarray.

The frequency offset is had by inputting the CW waveform to a digital phase shifter which is coupled to a digital accumulator to which clock inputs and steering inputs are fed to impose the frequency offset upon the CW waveform. This frequency offset is a synthetic time delay. In the receive mode the frequency offset is subtracted from the received signal to provide a target linear FM signal output.

DESCRIPTION OF THE PREFERRED EMBODIMENT

Figure 1:
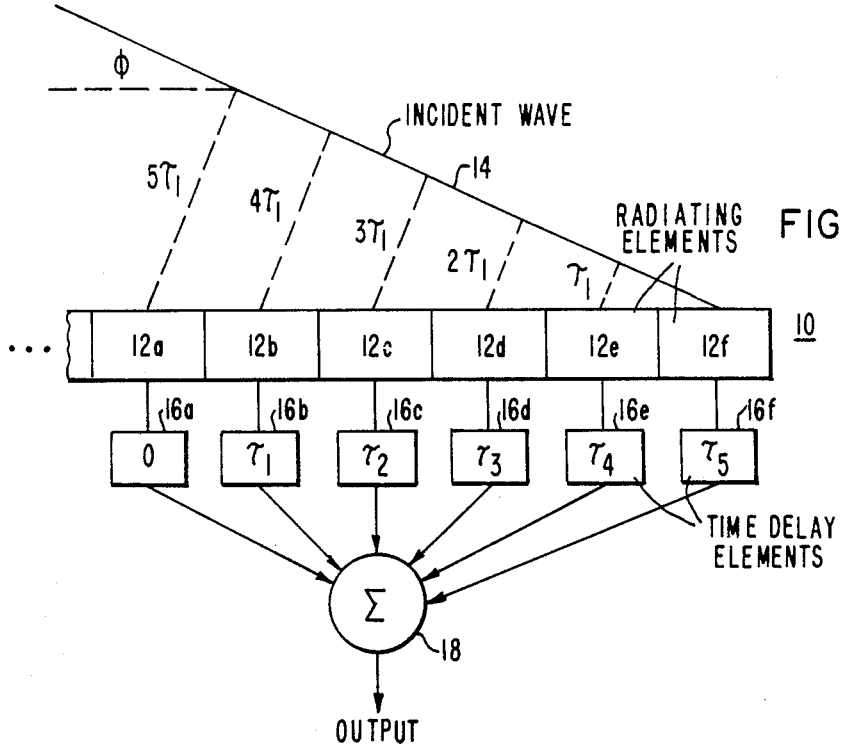
FIG. 1 is a schematic illustration of a phased array radar antenna which illustrates an incident wave at an angle $\phi$ relative to the planar antenna.
Figure 2A:
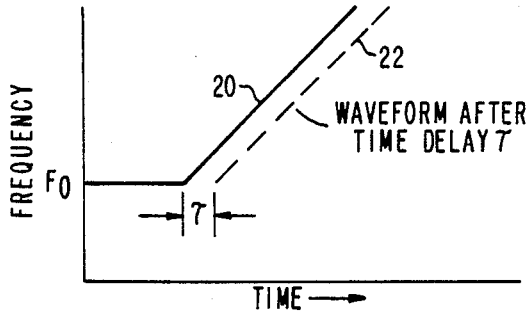
FIG. 2 is a plot of frequency versus time for an initial waveform, and for a waveform of the same characteristic but after a time delay $\tau$.
FIG. 2B is a plot of frequency versus time for an initial waveform, and for a waveform upon which a frequency offset of $\Delta F$ has been imposed.
Figure 2B:
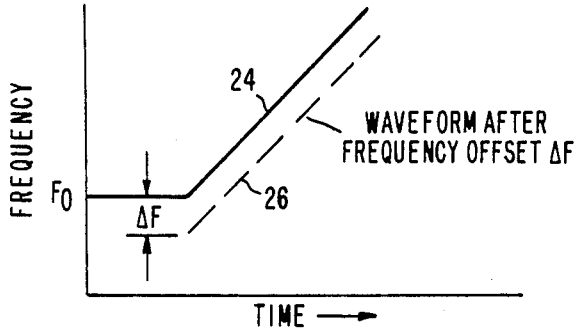
Figure 3:
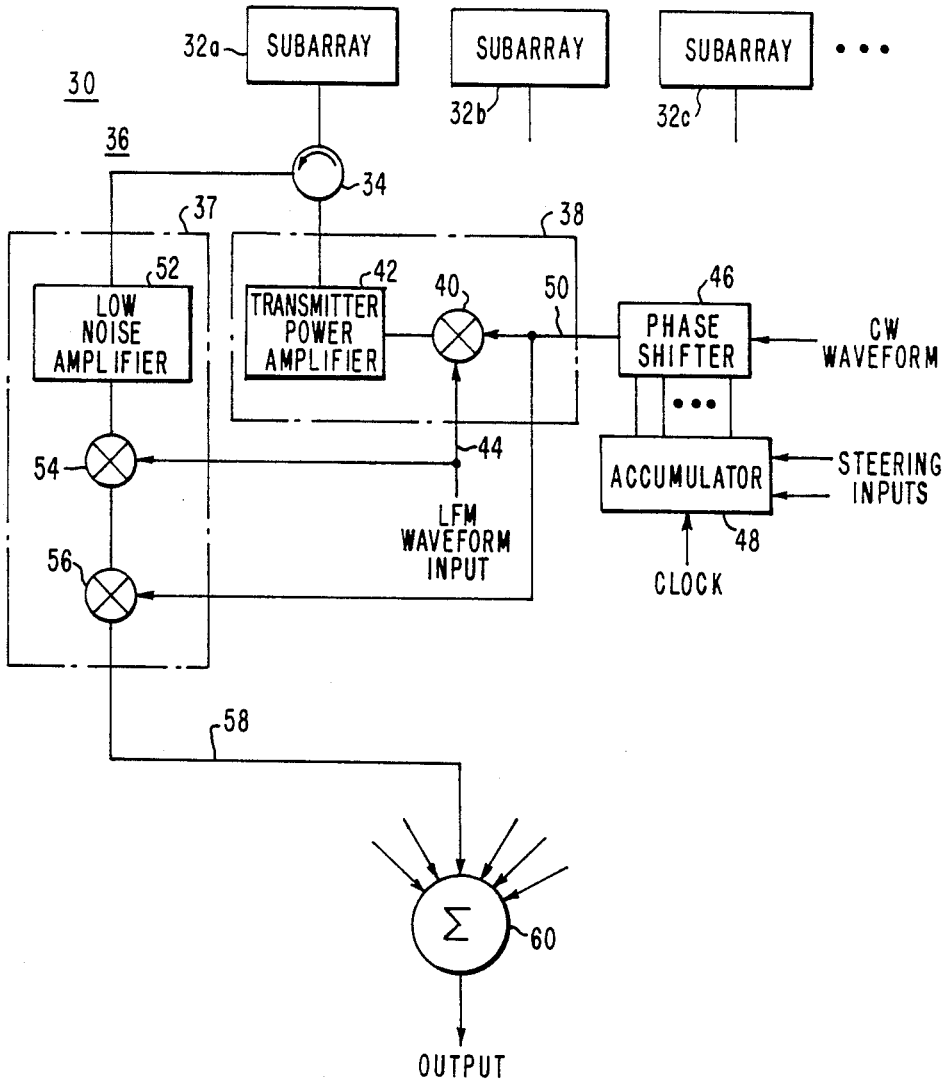
FIG. 3 is a schematic illustration of one embodiment of the electronically steerable phased array radar antenna system of the present invention.
Figure 4:
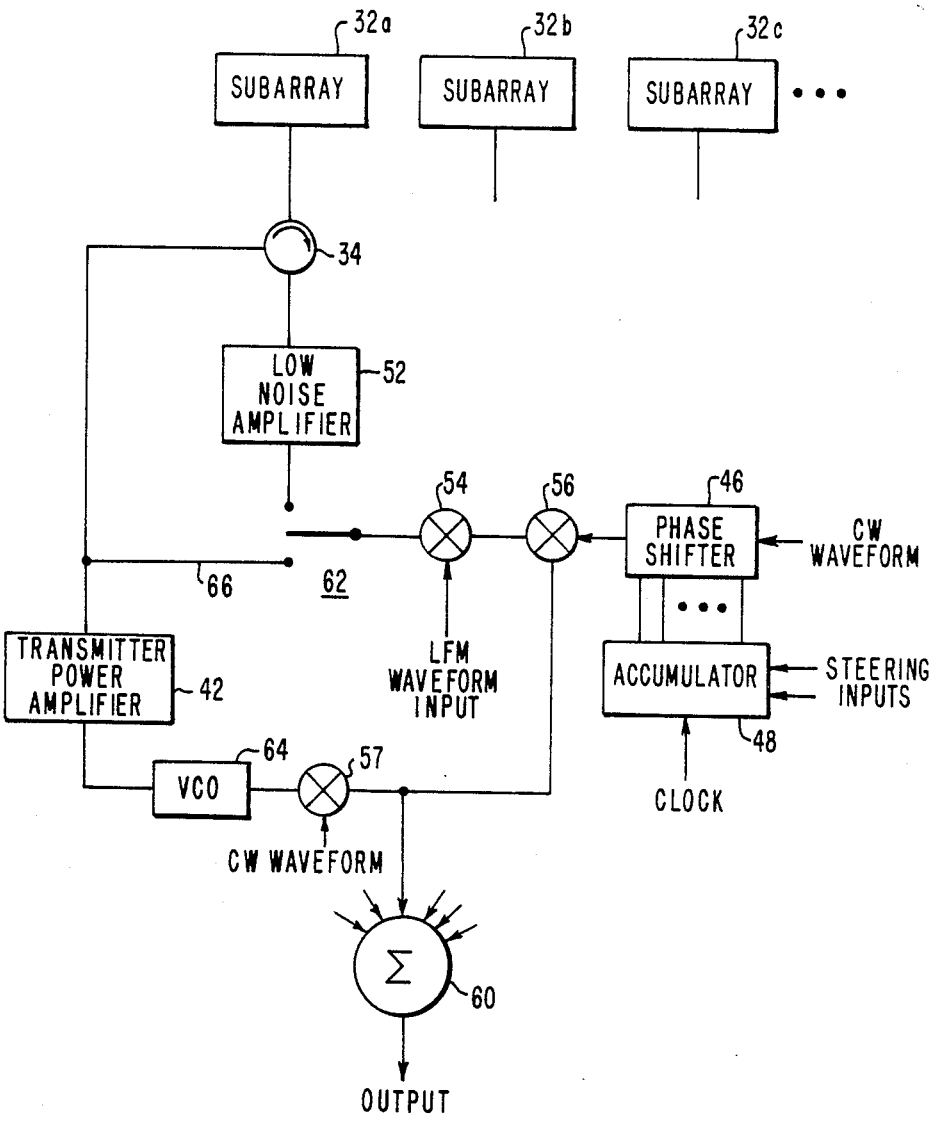
FIG. 4 is a schematic illustration of another embodiment electronically steerable phased array radar antenna system of the present invention.

The invention can be best understood by reference to FIGS. 1, 2A, 2B, which illustrate the principles upon which the embodiments of the present invention shown in FIGS. 3 and 4 are based.

In FIG. 1, a planar radar antenna 10 includes a plurality of radiating/receiver elements 12a–12f which can be individual elements or subarrays made up of a plurality of elements. The incident wave 14 is shown arriving at an angle $\phi$ relative to the planar antenna 10. The incident wave 14 first arrives at radiating/receiver element 12f at time 0, and thereafter arriving at time $\tau 1$ at element 12e and so on until at time $\tau 5$ the wave reaches element 12a. The time $\tau$ between incidence of the wave at adjacent elements is had from $$\tau = (Ls/c) \sin \phi,$$

where Ls is the element spacing, $\phi$ is the incidence angle, and c is the speed of light.

In order to correctly receive the incident wave from angle $\phi$, the received signals from the elements 12a–12f must be delayed by time delay elements 16a–16f by the times $\tau 5$ for element 12f, $\tau 4$ for element 12d, and so on until element 12a has 0 delay time. The time delayed received signals from the receiving elements 12a–12f can then be coherently summed at summing means 18. Thus, the time delayed received signals from the incident wave arrive at the summing means simultaneously.

FIG. 2A plots an intial waveform 20 with frequency plotted against time, and a time delayed waveform 22 which is delayed by time $\tau$ from waveform 20.

FIG. 2B plots an initial waveform 24 with frequency plotted against time, and a frequency offset waveform 26 which is offset from waveform 24 by $\Delta F$.

The illustrations of FIGS. 2A and 2B show that a time delay is equivalent to a frequency offset except for the small portions at the beginning and the end of the waveform. The frequency offset waveform 26 only differs from the time delayed waveform 22 at the beginning and end of waveform 26.

Thus, if a time delay of $\tau$ is desired to insure coherent reception of the incident signal, the same result can be achieved by a frequency offset of $\Delta F = k \times \tau$, where k is the waveform slope in Hertz per second. This frequency offset can serve as a synthesized time delay.

One embodiment of the present invention is shown schematically in FIG. 3. An electronically steerable phased array radar antenna system 30 comprises a plurality of antenna subarrays 32a, 32b, and 32c. Each subarray 32a–32c is connected via a microwave circulator 34 to a transmit-receive module 36. The transmit-receive module 36 includes transmit portion 38 which includes microwave mixer 40 and transmitter power amplifier 42. A common linear FM waveform is generated from a common generator (not shown) and fed via line 44 to the mixer 40. A CW waveform is fed to digital phase shifter 46 which is coupled to digital accumulator 48. The CW waveform is fed to phase shifter 46 and a frequency offset is imposed on the CW waveform using the commonly practiced serrodyne technique, where the phase is increased in equal steps in response to the digital accumulator 48 output. The accumulator 48 is fed a clock signal and beam steering inputs. The accumulator 48 is a digital register with clock inputs, and the beam steering inputs are an initial condition value and waveform slope increment values. Every time the register is clocked the waveform slope value is added to the value appearing at the register output and the sum of the values is loaded in the register. Successive clock inputs produce a register output which is a staircase waveform of controlled slope with the slope input providing an increment from the initial value and from each succeeding value.

The frequency offset thus imposed on the CW waveform by the phase shifter is proportional to the clock rate which is typically a fixed rate and the step size per clock which is typically programmable. The time delay for each subarray is thereby controlled by selecting the step size per clock for the accumulator for that subarray.

The CW waveform with its frequency offset is fed via line 50 to the mixer 40 where it is added to the linear FM waveform. The mixer 40 output is a resultant linear FM waveform with the frequency offset which is applied to the transmitter power amplifier 42, and after being amplified this waveform is passed through circulator 34 to the subarray 32a to be radiated in the desired direction.

Received signals which are received as by subarray 32a are passed via circulator 34 to low noise amplifier 52. The amplified received signal is then converted to an intermediate frequency by mixer 54 to which is also fed the linear FM waveform. This intermediate frequency received signal is frequency offset from its nominal value by $\Delta F = k \times \tau$, as was described above. The frequency offset is removed from the IF received signal in mixer 56 to which is also fed the frequency offset CW waveform from phase shifter 46. The output of mixer 56 is a waveform with the frequency offset removed, and this received signal is fed via line 58 to a common summing means 60 to which are fed the received signals from all of the subarrays 32a–32c. The received signals are coherently added in common summing means 60 to form the output composite received signal.

In another embodiment of the present invention seen in FIG. 4, where like numbers refer to like components, the design is modified to include a phase locked loop to improve the linearity in the transmitted waveform. The transmitter power amplifier 42 is typically a travelling wave tube which is responsible for producing phase nonlinearity in the amplified waveform. A switching means 62 serves to close the phase locked loop to the transmitter power amplifier during transmit with voltage controlled oscillator (VCO) 64 being included in the phase locked loop.

In the transmit mode with switching means 62 connecting line 66 to the mixer 54, a sample of the output of power amplifier 42 is fed to mixer 54 to which the highly linear FM waveform is fed. The phase locked loop linearizes the transmitted waveform by tracking the highly linear FM waveform. This transmit loop further introduces the frequency offset and synthetic time delay for beam steering, by having the frequency offset CW waveform which is produced by the phase shifter 46, as described above with respect to the FIG. 3 embodiment, fed to mixer 56. The output of mixer 56 is applied to mixer 56 to which is also fed the CW waveform, and mixer 57 functions to convert the intermediate frequency signal outputted from mixer 56 to the baseband to phase lock the voltage controlled oscillator 64 to the transmit frequency.

In this embodiment of FIG. 4, the transmitter output is linearized and synthetically time delayed by the phase locked loop.

In the receive mode switch 62 connects the low noise amplifier 52 to the mixer 54 and so on in essentially the same way as described with respect to the FIG. 3 embodiment.

Thus, a phased array radar antenna system has been described which utilizes wideband linear FM waveforms, and which employs a synthetic time delay generated using conventional hardware.

We claim:

1. An electronically steerable phased array radar antenna system for transmitting and receiving broadband linear FM signals, wherein the antenna comprises a plurality of generally planar spaced antenna subarrays each of which is connected by circulating means to a transmit-receive module, transmit-receive module includes a digital phase shifter means to which is input a CW signal and means for imposing a predetermined frequency offset upon the CW signal, which frequency offset for each antenna subarray is the product of the desired time delay for the respective antenna subarray times the slope of the linear FM signal, and a transmit portion of the transmit-receive module which includes combiner means to which is input a linear FM signal which is combined with the frequency offset CW signal input from the phase shifter means to provide a frequency offset linear FM signal input to the circulator means for transmission by the antenna subarray, and a receive portion of the transmit-receive module which includes low noise amplifier means connected to the circulator means for amplifying the signal received by the antenna subarray, and first and second combiner means serially connected to the amplifier means, with the linear FM signal input to the first combiner means and the frequency offset linear FM signal is input to the second combiner means to yield a frequency offset subtracted coherent linear FM target signal.

2. The system set forth in claim 1, wherein a common summing means is connected to each antenna subarray transmit-receive module for coherently combining the received target linear FM signals from each antenna subarray.

3. The system set forth in claim 1, wherein the transmit-receive module includes a transmit loop which includes a voltage controlled oscillator which is serially connected in a phase locked loop with a transmitter power amplifier to provide a highly linear FM signal which is amplified and fed via circulator means to the antenna subarray.

4. The system set forth in claim 1, wherein the means for imposing a predetermined frequency offset upon the CW signal is a digital accumulator means connected to the digital phase shifter means, which accumulator means has input thereto a clock signal and beam steering signal which is a function of the desired time delay for each antenna array and also of the slope of the linear FM signal, which accumulator means output effects control of the digital phase shifter means to impose the predetermined frequency offset onto the CW signal.

5. A method of transmitting and receiving broadband linear FM signals in an electronically steerable phased array radar antenna system so that the broadband linear FM signal can be transmitted and received at a predetermined steered angle relative to generally planar antenna subarrays, which subarrays are each connected to and fed by a transmit-receive module which includes digital phase shifter means, which method comprises;

(a) applying a broadband linear FM signal to each transmit-receive module;

(b) applying a CW signal to the phase shifter means of each transmit-receive module;

(c) imposing a predetermined frequency offset upon the CW signal in each transmit-receive module, which frequency offset is the product of a desired time delay and the slope of the linear FM signal;

(d) combining the frequency offset CW signal with the linear FM signal to provide for transmitting a frequency offset linear FM signal at each antenna subarray, and for receiving a frequency offset subtracted coherent linear FM target signal.

* * * * *